United States Patent [19]

Calvert

[11] 4,084,282

[45] Apr. 18, 1978

[54] ROTARY BRUSH FOR REMOVING HAIR FROM HAIR BRUSHES

[76] Inventor: Madeleine M. Calvert, 17861 NE. 13th Ave., North Miami Beach, Fla. 33162

[21] Appl. No.: 810,414

[22] Filed: Jun. 27, 1977

[51] Int. Cl.[2] ..... A46B 17/06; A46B 15/00

[52] U.S. Cl. ..... 15/38; 15/23; 15/48; 119/91

[58] Field of Search ..... 15/38, 39, 23, 48; 119/91

[56] References Cited

U.S. PATENT DOCUMENTS

| | | | |
|---|---|---|---|
| 3,431,571 | 3/1969 | Kraus | 15/23 |
| 3,470,575 | 10/1969 | Larson et al. | 15/38 |
| 3,590,413 | 7/1971 | Coulson, Jr. | 15/38 |

*Primary Examiner*—Edward L. Roberts

*Attorney, Agent, or Firm*—Salvatore G. Militana

[57] ABSTRACT

A rotary brush for removing hair from hair brushes having a rotatable shaft upon which the bristles are mounted, a slotted portion extending along the full length of the shaft and a sharpened bladed portion slidably mounted in the slotted portion for cutting hair that had been removed by the rotary brush from hair brushes and became wound about the shaft thereof.

3 Claims, 4 Drawing Figures

ROTARY BRUSH FOR REMOVING HAIR FROM HAIR BRUSHES

BACKGROUND OF THE INVENTION

1. Field of the Invention

This invention relates to hair brushes and is more particularly directed to a rotary brush for removing hair from the conventional hair brush upon which hair is entangled thereon from brushing hair.

2. Description of the Prior Art

At the present time, there is no rotary brush that is capable of removing hair from conventional hair brushes and from being divested readily of the hair that has been removed from hair brushes and become entangled in the brushes of the rotary brush. At the present time a person desiring to remove entangled hair from a hair brush after having brushed a person's hair, he uses a second hair brush to brush out the hair from the first hair brush and then removes the less entangled hair from the second hair brush with his finger. Another method of removing highly entangled hair from a hair brush is by combing the hair out of the brush. Obviously these methods of removing entangled hair in a hair brush are neither very effective nor hygienic as well as being an unpleasant task to the person attempting to cleanse the hair brush of entangled hair. The present invention contemplates avoiding the above objections to removing hair from a hair brush.

SUMMARY OF THE INVENTION

Therefore, a principal object of the present invention is to provide a power operated rotary hair brush for removing hair entangled in a conventional hair brush quickly and effectively.

Another object of the present invention is to provide a rotary hair brush for removing hair from a conventional hair brush with means for cutting the hair that has become wound about the rotary hair brush whereby the removal of the hair is readily effected.

A further object of the present invention is to provide a rotary hair brush from a conventional hair brush with a removable shield and slidable hair cutting blade whereby the latter is readily manipulated for cutting the hair wrapped around the rotary brush upon removing the shield.

With these and other objects in view, the invention will be best understood from a consideration of the following detailed description taken in connection with the accompanying drawing forming a part of this specification, with the understanding, however, that the invention is not confiend to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
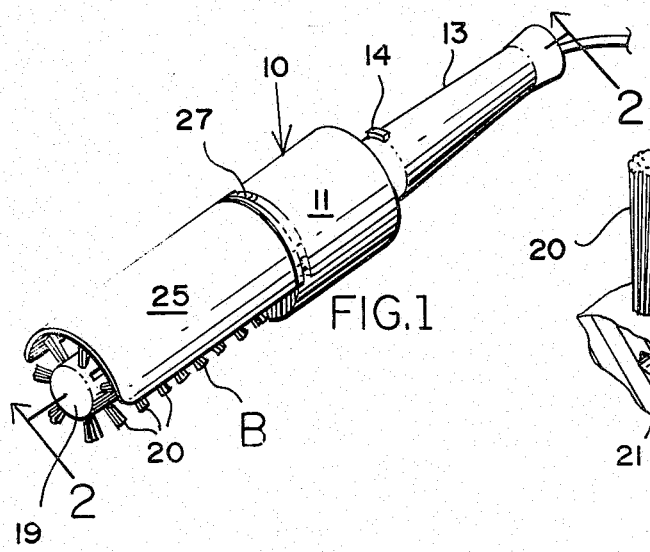
FIG. 1 is a perspective view of my device for removing hair from hair brushes.
Figure 4:
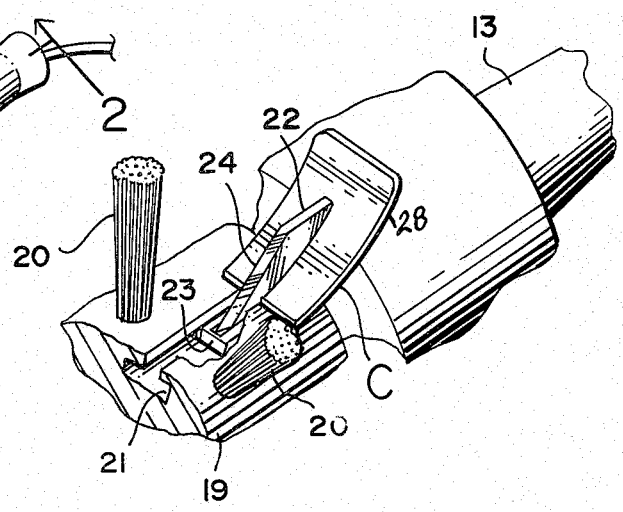
FIG. 4 is a fragmentary perspective view of the shaft and cutting member at the position of the longitudinal slot.
Figure 2:
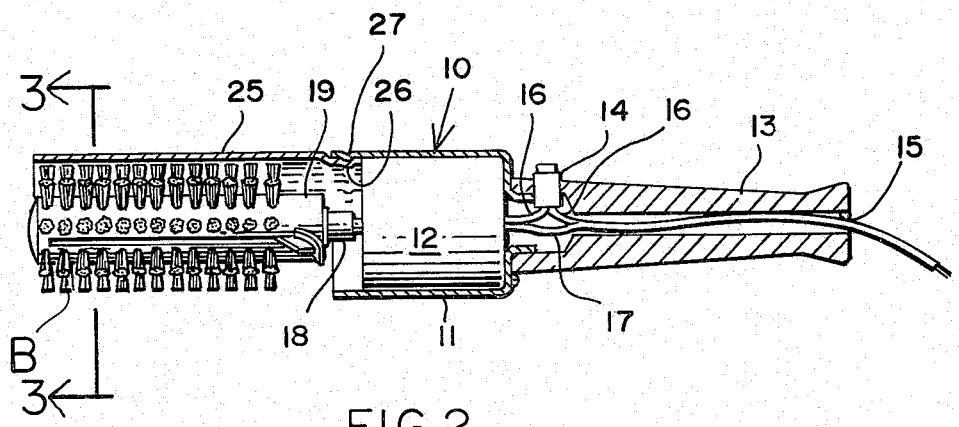
FIG. 2 is a longitudinal cross sectional view taken along the line 2—2 of FIG. 1.
Figure 3:
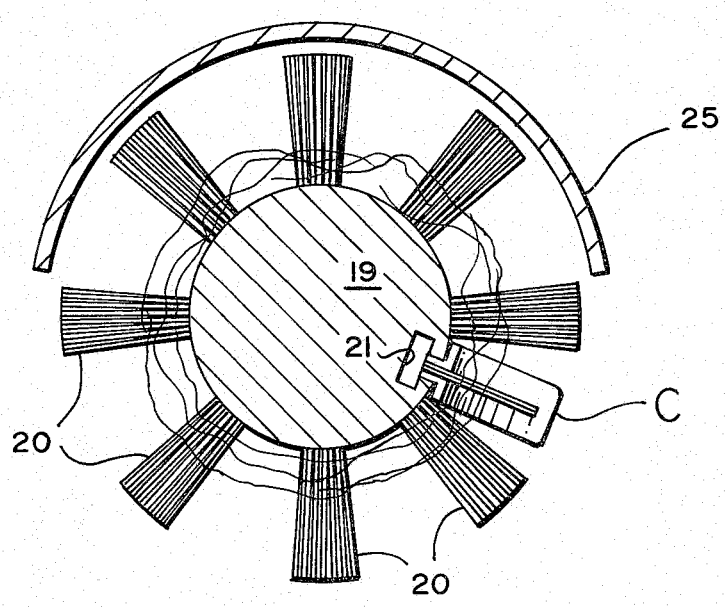
FIG. 3 is a transverse cross sectional view taken along the line 3—3 of FIG. 2.

Referring to the drawing wherein like numerals are used to designate similar parts throughout the several views, the numeral 10 refers to my rotary brush for removing hair from hair brushes consisting of a cylindrical housing 11 in which an electrical motor 12 is contained. Attached to one end of the housing 11 is a handle 13 having a switch 14 mounted thereon and an axially disposed bore 15 through which wires 16 and 17 extend from a source of power (not shown) and connected in the conventional manner to the switch 14 and the motor 12. The switch 14 is a conventional three way switch in construction having "on", "off" and "high" positions for controlling the motor 12.

Extending outwardly of the motor 12 at the other end of the housing 11 is a motor shaft 18 on which is mounted a cylindrical brush holding member 19. Bristles 20 extend in rows radially of the cylindrical member 19 to form a rotary brush —B—. Between a pair of rows of bristles 20 is a T-shaped slotted portion 21. A hair cutting member —C— which is slidably mounted in the slotted portion 21 consists of a blade portion 22 having an enlarged foot portion 23 which secures the member —C— against removal from the slotted portion 21. The blade portion 22 is sharpened as at 24 along one edge thereof while on the opposite edge is a tab 28 for pulling and/or pushing the cutting member —C— along the slotted portion 21. It is to be noted that the slotted portion 21 is blocked off at each end to prevent the cutting member —C— from being removed from the brush holding cylinder 19. A removable shield 25 extends the full length of the brush —B— and approximately one-half about the periphery thereof. The shield 25 is provided with a beaded end portion 26 received by and engaging a similar beaded portion 27 formed on the end of the housing 11. By squeezing together the outer edges of the shield 25, the shield 25 may be readily removed from or replaced onto the housing 11.

In the normal use of my rotary brush 10 for removing hair from a conventional hair brush having strands of hair entangled thereon, the operator will hold the conventional hair brush in one hand and my rotary brush 10 in the other hand. The switch 14 is then actuated to activate the motor 12 and effect the rotation of the brush holder 19. The operator will then pass the rapidly rotating brushes 20 of my rotary hair brush 10 through the bristles of the conventional hair brush whereby hair entangled in the hair brush will be removed from the hair brush and become entangled in the brushes 20 of my rotary hair brush 10 and wound about the cylindrical brush holder 19. After all of the hair has been removed from the conventional hair brush, the switch 14 is then actuated to end the rotary motion of the brush —B—. The operator now removes the shield 25 by merely squeezing the side edge portions thereof together and places his finger behind the tab 28 of the cutting member —C— which is positioned at the inner end portion of the cylindrical brush holder 19. He draws the cutting member —C forwardly along the slot 21 causing the cutting edge 24 of the blade 22 to cut the hair which had been wound about the cylindrical brush holder 19. The hair is then readily removed from the brush —B— upon placing a pointed tool between the cylindrical brush holder 19 and the hair at the opposite side of the slotted portion 21 and lifting the hair outwardly therefrom. After the bristles 20 have been freed of all hair, the cutting member —C— is slid along the slotted portion 21 to its inner most position and the shield 25 is replaced on the end of the housing 11. My hair removing brush 10 is now stored and ready to be used again for removing hair from conventional hair brushes.

What I claim as new and desire to secure by Letters Patent is:

1. A rotary hair removing brush for removing hair entangled in conventional hair brushes having a motor, a substantially cylindrical bristle holding member connected to said motor, a slotted portion mounted on said cylindrical member along substantially the full length thereof and hair cutting means slidably mounted in said slotted portion for cutting hair wound about said cylindrical member.

2. The structure as recited by claim 1 wherein said cutting means comprises a blade portion having a sharpened edge portion on one side thereof and a tab portion mounted on the other side for sliding said cutting means along said slotted portion.

3. The structure as recited by claim 2 wherein said slotted portion terminating adjacent to the ends of said cylindrical bristle holding member whereby said cutting means is prevented from being removed from said cylindrical member.

* * * * *